US010068699B1

(12) United States Patent
Leong et al.

(10) Patent No.: US 10,068,699 B1
(45) Date of Patent: Sep. 4, 2018

(54) INTEGRATED INDUCTOR AND FABRICATION METHOD THEREOF

(71) Applicant: Realtek Semiconductor Corp., Hsinchu (TW)

(72) Inventors: Poh-Boon Leong, Pleasanton, CA (US); Chia-Liang (Leon) Lin, Fremont, CA (US)

(73) Assignee: REALTEK SEMICONDUCTOR CORP., Hsinchu (TW)

( * ) Notice: Subject to any disclaimer, the term of this patent is extended or adjusted under 35 U.S.C. 154(b) by 0 days.

(21) Appl. No.: 15/446,043

(22) Filed: Mar. 1, 2017

(51) Int. Cl.

| | |
|---|---|
| ***H01F 27/28*** | (2006.01) |
| ***H01F 5/00*** | (2006.01) |
| ***H01F 27/40*** | (2006.01) |
| ***H01F 17/00*** | (2006.01) |
| ***H01F 27/29*** | (2006.01) |
| ***H01F 41/04*** | (2006.01) |

(52) U.S. Cl.
CPC ..... *H01F 27/40* (2013.01); *H01F 17/0006* (2013.01); *H01F 27/29* (2013.01); *H01F 41/041* (2013.01); *H01F 2017/0086* (2013.01)

(58) Field of Classification Search
USPC ..... 336/223, 232, 105, 200
See application file for complete search history.

(56) References Cited

U.S. PATENT DOCUMENTS

| | | | | |
|---|---|---|---|---|
| 6,653,681 | B2 * | 11/2003 | Appel | H01L 23/5222 257/307 |
| 7,327,555 | B2 | 2/2008 | Yeh et al. | |
| 7,612,645 | B2 | 11/2009 | Yeh et al. | |
| 8,592,943 | B2 * | 11/2013 | Wu | H01L 27/08 257/277 |
| 8,901,710 | B2 * | 12/2014 | Anderson | H01L 28/60 257/307 |
| 9,779,868 | B2 * | 10/2017 | Hecht | H01F 19/04 |
| 2004/0174655 | A1 * | 9/2004 | Tsai | H01L 23/5223 361/306.3 |
| 2007/0069717 | A1 * | 3/2007 | Cheung | H03F 3/211 324/750.26 |
| 2008/0309429 | A1 * | 12/2008 | El Rai | H01F 17/0006 333/167 |
| 2011/0043316 | A1 * | 2/2011 | Yang | H01F 19/04 336/192 |

* cited by examiner

*Primary Examiner* — Ronald Hinson
(74) *Attorney, Agent, or Firm* — McClure, Qualey & Rodack, LLP

(57) ABSTRACT

An inductor includes: a first coil of metal trace laid out to be symmetrical with respect to a first axis; a second coil of metal trace laid out to be substantially a mirror image of the first coil of metal trace with respect to a second axis; a first coupling capacitor configured to provide a capacitive coupling between a first segment within the first coil of metal trace and a counterpart of the first segment within the second coil of metal trace; and a second coupling capacitor configured to provide a capacitive coupling between a second segment within the first coil of metal trace and a counterpart of the second segment within the second coil of metal trace.

18 Claims, 2 Drawing Sheets

INTEGRATED INDUCTOR AND FABRICATION METHOD THEREOF

BACKGROUND OF THE INVENTION

Field of the Invention

The present invention generally relates to inductor design and more particularly to an inductor design having improved quality factor.

Description of Related Art

Inductors are widely used in many applications. A recent trend is to include a plurality of inductors on a single chip of an integrated circuit. An important issue related to the co-existence of multiple inductors on a single chip of an integrated circuit is the existence of an undesired magnetic coupling among said multiple inductors that is detrimental to a function of the integrated circuit. To alleviate the undesired magnetic coupling among multiple inductors, a sufficiently large physical separation between any of two inductors is often needed. This leads to a need to enlarge a total area and thus a cost of the integrated circuit.

What is desired is a method for constructing an inductor that is inherently less susceptible to a magnetic coupling with other inductors fabricated on the same chip of an integrated circuit.

BRIEF SUMMARY OF THIS INVENTION

In an embodiment, an inductor includes: a first coil of a metal trace laid out to be substantially symmetrical with respect to a first axis; a second coil of the metal trace laid out to be substantially a mirror image of the first coil of the metal trace with respect to a second axis; a first coupling capacitor configured to provide a capacitive coupling between a first segment within the first coil of the metal trace and a counterpart of the first segment within the second coil of the metal trace; and a second coupling capacitor configured to provide a capacitive coupling between a second segment within the first coil of the metal trace and a counterpart of the second segment within the second coil of the metal trace. In an embodiment, the first coupling capacitor is substantially a mirror image of the second coupling capacitor with respect to the first axis. In an embodiment, the first segment and the second segment within the first coil of the metal trace are located near a first end and a second end, respectively, of the first coil of the metal trace. In an embodiment, a first voltage and a second voltage of a differential signal are applied to the first end and the second end, respectively, of the first coil of the metal trace. In an embodiment, the first coil of the metal trace further includes a center tap located approximately at a midpoint of the first coil of the metal trace, wherein said center tap is coupled to either a voltage source or a current source. In an embodiment, the second coil of the metal trace further includes a center tap located approximately at a midpoint of the second coil of the metal trace, wherein said center tap is coupled to either a voltage source or a current source.

In an embodiment, a method includes: incorporating a first coil of a metal trace laid out to be substantially symmetrical with respect to a first axis; incorporating a second coil of the metal trace laid out to be approximately a mirror image of the first coil of the metal trace with respect with a second axis; incorporating a first coupling capacitor configured to provide a capacitive coupling between a first segment within the first coil of the metal trace and a counterpart within the second coil of the metal trace; and incorporating a second coupling capacitor configured to provide a capacitive coupling between a second segment within the first coil of the metal trace and a counterpart within the second coil of the metal trace. In an embodiment, the first coupling capacitor is substantially a mirror image of the second coupling capacitor with respect to the first axis. In an embodiment, the first segment and the second segment within the first coil of the metal trace are located near a first end and a second end, respectively, of the first coil of the metal trace. In an embodiment, a first voltage and a second voltage of a differential signal are applied to the first end and the second end, respectively, of the first coil of the metal trace. In an embodiment, the first coil of the metal trace further includes a center tap located approximately at a midpoint of the first coil of the metal trace, wherein said center tap is coupled to either a voltage source or a current source. In an embodiment, the second coil of the metal trace further includes a center tap located approximately at a midpoint of the second coil of the metal trace, wherein said center tap is coupled to either a voltage source or a current source.

DETAILED DESCRIPTION

The present invention relates to inductors. While the specification describes several example embodiments of the invention considered favorable modes of practicing the invention, it should be understood that the invention can be implemented in many ways and is not limited to the particular examples described below or to the particular manner in which any features of such examples are implemented. In other instances, well-known details are not shown or described to avoid obscuring aspects of the invention.

Persons of ordinary skill in the art understand terms and basic concepts related to microelectronics that are used in this disclosure, such as "voltage," "signal," "differential signal," "common mode," "capacitor," "inductor," "AC (alternating current)," "AC couple," "DC (direct current)," "DC couple," "voltage source," and "current source."

Figure 1:
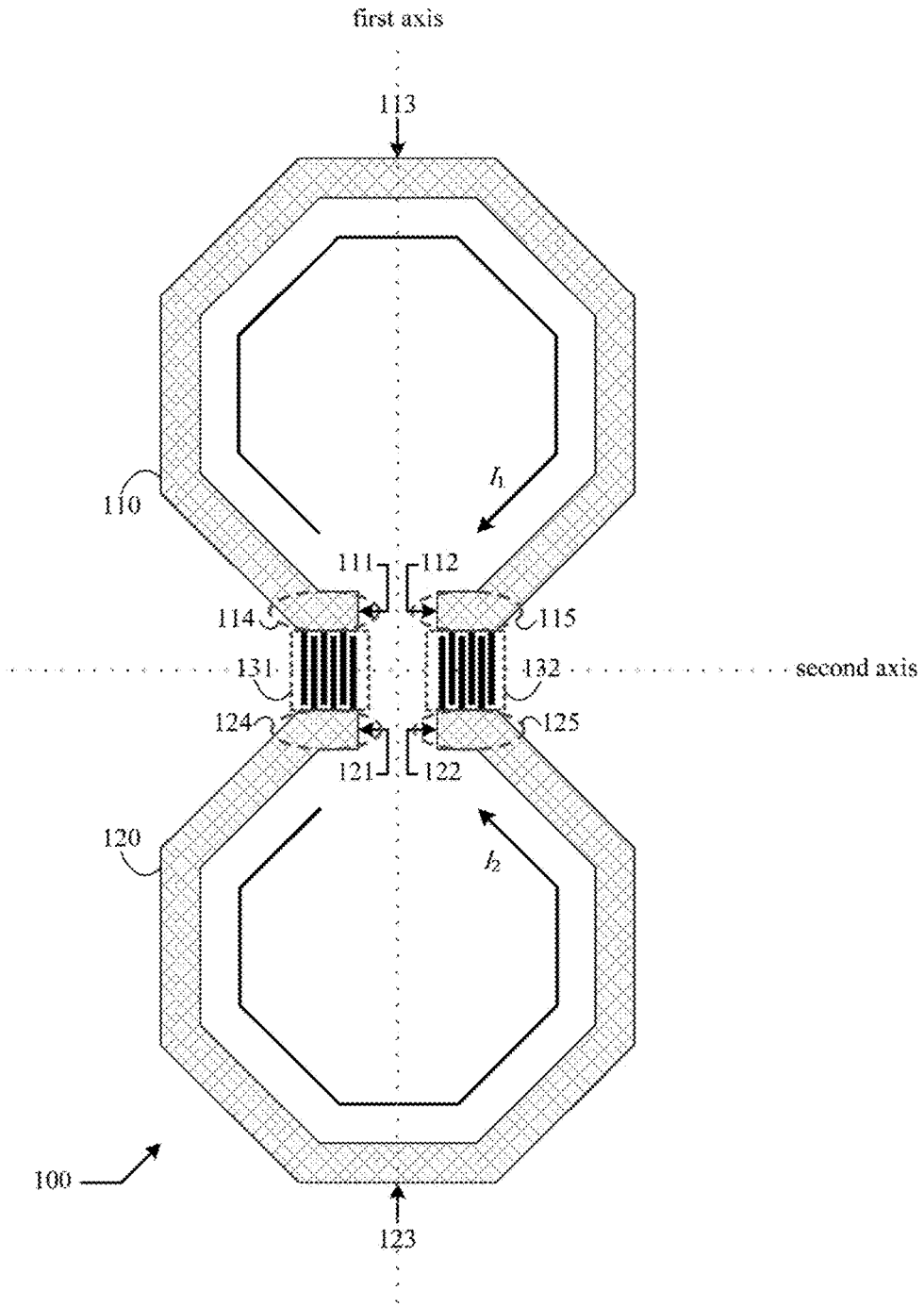
FIG. 1 shows a top view of a layout of an inductor in accordance with an embodiment of the present invention.

FIG. 1 depicts a top view of a layout of an inductor 100 in accordance with an embodiment of the present invention. The inductor 100 is fabricated on a silicon substrate and includes a first coil of metal trace 110, a second coil of metal trace 120, a first coupling capacitor 131, and a second coupling capacitor 132. For brevity, hereafter the first coil of metal trace 110 is simply referred to as the first coil 110, while the second coil of metal trace 120 is simply referred to as the second coil 120. The first coil 110 is laid out to be highly symmetrical with respect to a first axis. The second coil 120 is laid out to be nearly a substantial mirror image of the first coil 110 with respect to a second axis, wherein the second axis is substantially orthogonal to the first axis. The first (second) coil 110 (120) starts from a first (third) end 111 (121) and ends at a second (fourth) end 112 (122). The first (second) coupling capacitor 131 (132) is configured to provide a capacitive coupling between a first (second) segment 114 (115) and a third (fourth) segment 124 (125). Here, the first (second) segment 114 (115) is located within the first coil 110 near the first (second) end 111 (112), and the third (fourth) segment 124 (125) is located within the second coil 120 near the third (fourth) end 121 (122).

By way of example but not limitation, both the first coupling capacitor 131 and the second coupling capacitor 132 are of an interdigital topology. The first (second) coupling capacitor 131 (132) includes a first (second) set of metal traces extending from the first (second) segment 114 (115) to almost but never touch the third (fourth) segment 124 (125), and also a third (fourth) set of metal traces extending from the third (fourth) segment 124 (125) to almost but never touch the first (second) segment 114 (115), wherein the first (second) set of metal traces interdigitate with the third (fourth) set of metal traces. In an embodiment, the first coupling capacitor 131 and the second coupling capacitor 132 are laid out to be nearly a mirror image of each other with respect to the first axis. Due to the mirror-image symmetry, the third (fourth) segment 124 (125) can be said to be a counterpart of the first (second) segment 114 (115), while the third (fourth) end 121 (122) can be said to be a counterpart to the first (second) end 111 (112). Therefore, the first (second) coupling capacitor 131 (132) is configured to provide a capacitive coupling between the first (second) segment 114 (115) within the first coil 110 and its counterpart within the second coil 120.

Inductor 100 is suitable for a differential signaling application, wherein a signal of interest is a difference between a first voltage $V_+$ and a second voltage $V_-$. Ideally, the first voltage $V_+$ and the second voltage $V_-$ have the same DC value in a static scenario, but opposite AC values in a dynamic scenario, so that a rise (fall) of the first voltage $V_+$ comes with a fall (rise) of the second voltage $V_-$ with the same amount. When incorporating inductor 100 into an application network, the first voltage $V_+$ and the second voltage $V_-$ are applied to the first end 111 and the second end 112, respectively. Let a current flowing in the first (second) coil 110 (120) from the first (third) end 111 (121) to the second (fourth) end 112 (122) be $I_1$ ($I_2$). Note that in the dynamic scenario, $I_1$ ($I_2$) could be either positive or negative. When $I_1$ ($I_2$) is positive, the current flow in the first (second) coil 110 (120) is clockwise (counter-clockwise); when $I_1$ ($I_2$) is negative, the current flow in the first (second) coil 110 (120) is counter-clockwise (clockwise). In the dynamic scenario wherein a change in $V_+$ and $V_-$ leads to a positive (negative) voltage difference between the first end 111 and the second end 112 and consequently an increase (a decrease) in $I_1$, a change on the voltage difference between the third end 121 and the fourth end 122 follows, thanks to the coupling capacitors 131 and 132, and leads to an increase (decrease) in $I_2$.

In one embodiment, the coupling capacitors 131 and 132 are configured to provide a sufficiently strong coupling so that a voltage difference between the third end 121 and the fourth 122 end is substantially equal to a voltage difference between the first end 111 and the second end 112. In this case, an increase (a decrease) in $I_1$ will come with an increase (a decrease) in $I_2$ of substantially the same amount. In other words, an increase in a clockwise (counter-clockwise) flow of current in the first coil 110 will come with an increase in a counter-clockwise (clockwise) flow of current in the second coil 120 with substantially the same amount. A change in a magnetic flux induced by the second coil 120 thus opposes a change in a magnetic flux induced by the first coil 110. Therefore, a coupling between the first coil 110 and another inductor fabricated in the same chip will be offset by a coupling between the second coil 120 and said another inductor. This helps to alleviate an overall mutual coupling between inductor 100 and said another inductor.

In an embodiment, a first center tap 113 located at a midpoint of the first coil 110 is connected to a common-mode node, wherein the common-mode node is coupled to either a voltage source or a current source.

In an embodiment, a second center tap 123 located at a midpoint of the second coil 120 is connected to a common-mode node, wherein the common-mode node is coupled to either a voltage source or a current source.

By way of example but not limitation, a physical dimension is approximately 200 by 200 and a width of metal trace is approximately 20 for both the first coil 110 and the second coil 120. By way of example but not limitation, a physical separation between the first coil 110 and the second coil 120 is approximately 40 By way of example but not limitation, a capacitance value is approximately 5 pF for both the first coupling capacitor 131 and the second coupling capacitor 132. By way of example but not limitation, a physical separation is approximately 40 between the first end 111 and the second 112.

The first coil 110 and the second coil 120 in FIG. 1 are shown to be a single-turn coil, however, it is understood that person skill in the relevant art may design a multi-turn coil for the first coil 110 and the second coil 120.

In another embodiment, first coil 110, second coil 120, first coupling capacitor 131 and second coupling capacitor 132 can be implemented through multiple metal layers, such as redistribution layer and/or metal layers, and connected by via plug(s).

Figure 2:
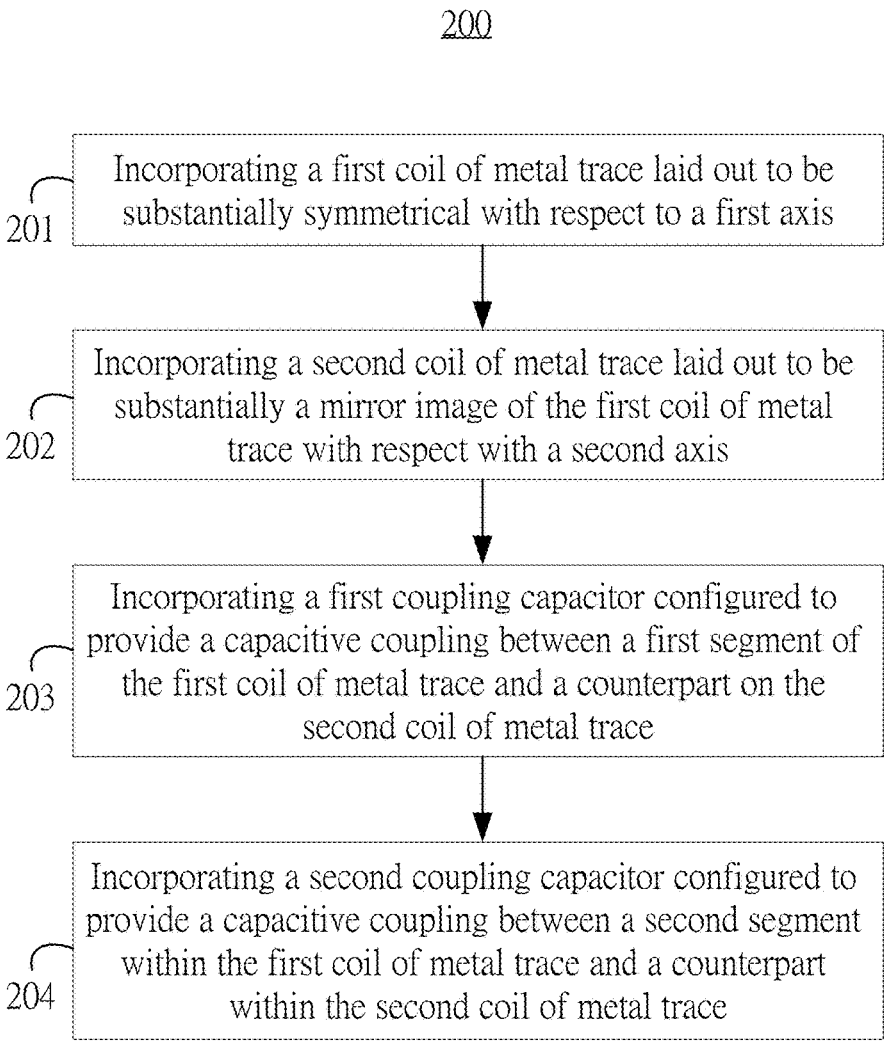
FIG. 2 shows a flow chart in accordance with an embodiment of the present invention.

In an embodiment illustrated by a flow diagram 200 shown in FIG. 2, a method comprises: (step 201) incorporating a first coil of metal trace laid out to be substantially symmetrical with respect to a first axis; (step 202) incorporating a second coil of metal trace laid out to be approximately a mirror image of the first coil of metal trace with respect with a second axis; (step 203) incorporating a first coupling capacitor configured to provide a capacitive coupling between a first segment within the first coil of metal trace and a counterpart within the second coil of metal trace; and (step 204) incorporating a second coupling capacitor configured to provide a capacitive coupling between a second segment within the first coil of metal trace and a counterpart within the second coil of metal trace.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An apparatus comprising: a first coil of metal trace laid out to be substantially symmetrical with respect to a first axis; a second coil of metal trace laid out to be substantially a mirror image of the first coil of metal trace with respect to a second axis, wherein the second axis is substantially orthogonal to the first axis; a first coupling capacitor configured to provide a capacitive coupling between a first segment within the first coil of metal trace and a counterpart of the first segment on the second coil of metal trace; and a second coupling capacitor configured to provide a capacitive coupling between a second segment within the first coil of metal trace and a counterpart of the second segment on the second coil of metal trace; wherein the first coupling capacitor includes a first set of metal traces extending from the first coil of metal trace and a third set of metal traces extending from the second coil of metal trace, wherein the first set of metal traces and the third set of metal traces are arranged in an interdigital configuration, wherein the first set of metal traces do not touch the second coil of metal trace, and wherein the third set of metal traces do not touch the first coil of metal trace; and wherein the second coupling capacitor includes a second set of metal traces extending from the first coil of metal trace and a fourth set of metal of traces extending from the second coil of metal trace, wherein the second set of metal traces and the fourth set of metal traces are arranged in an interdigital configuration, wherein the second set of metal traces do not touch the second coil of metal trace, and wherein the fourth set of metal traces do not touch the first coil of metal trace.

2. The apparatus of claim 1, wherein the first coupling capacitor is substantially a mirror image of the second coupling capacitor with respect to the first axis.

3. The apparatus of claim 1 is fabricated on a silicon chip.

4. The apparatus of claim 1, wherein the first segment and the second segment within the first coil of metal trace are located near a first end and a second end, respectively, of the first coil of metal trace.

5. The apparatus of claim 4, wherein a first voltage and a second voltage of a differential signal are applied to the first end and the second end, respectively, of the first coil of metal trace.

6. The apparatus of claim 1, wherein the first coil of metal trace further includes a center tap located approximately at a midpoint of the first coil of metal trace.

7. The apparatus of claim 6, wherein said center tap is coupled to either a voltage source or a current source.

8. The apparatus of claim 1, wherein the second coil of metal trace further includes a center tap located substantially at a midpoint of the second coil of metal trace.

9. The apparatus of claim 8, wherein said center tap is coupled to either a voltage source or a current source.

10. A method of fabricating an inductor comprising: incorporating a first coil of metal trace laid out to be substantially symmetrical with respect to a first axis; incorporating a second coil of metal trace laid out to be substantially a mirror image of the first coil of metal trace with respect with a second axis, wherein the second axis is substantially orthogonal to the first axis; incorporating a first coupling capacitor configured to provide a capacitive coupling between a first segment within the first coil of metal trace and a counterpart within the second coil of metal trace; and incorporating a second coupling capacitor configured to provide a capacitive coupling between a second segment within the first coil of metal trace and a counterpart within the second coil of metal trace; wherein incorporating the first coupling capacitor comprises incorporating a first set of metal traces extending from the first coil of metal trace and a third set of metal traces extending from the second coil of metal trace, wherein the first set of metal traces and the third set of metal traces are arranged in an interdigital configuration, wherein the first set of metal traces do not touch the second coil of metal trace, and wherein the third set of metal traces do not touch the first coil of metal trace; and wherein incorporating the second coupling capacitor comprises incorporating a second set of metal traces extending from the first coil of metal trace and a fourth set of metal of traces extending from the second coil of metal trace, wherein the second set of metal traces and the fourth set of metal traces are arranged in an interdigital configuration, wherein the second set of metal traces do not touch the second coil of metal trace, and wherein the fourth set of metal traces do not touch the first coil of metal trace.

11. The method of claim 10, wherein the first coupling capacitor is substantially a mirror image of the second coupling capacitor with respect to the first axis.

12. The method of claim 10, wherein the first coil of metal trace, the second coil of metal trace, the first coupling capacitor, and the second coupling capacitors are all fabricated on a silicon chip.

13. The method of claim 10, wherein the first segment and the second segment within the first coil of metal trace are located near a first end and a second end, respectively, of the first coil of metal trace.

14. The method of claim 13, wherein a first voltage and a second voltage of a differential signal are applied to the first end and the second end, respectively, of the first coil of metal trace.

15. The method of claim 10, wherein the first coil of metal trace further includes a center tap located approximately at a midpoint of the first coil of metal trace.

16. The method of claim 15, wherein said center tap is coupled to either a voltage source or a current source.

17. The method of claim 10, wherein the second coil of metal trace further includes a center tap located substantially at a midpoint of the second coil of metal trace.

18. The method of claim 17, wherein said center tap is coupled to either a voltage source or a current source.

* * * * *